US008672201B2

(12) United States Patent
Craighead

(10) Patent No.: US 8,672,201 B2
(45) Date of Patent: Mar. 18, 2014

(54) CONCEALABLE HANDGUN HOLSTER WITH DECEPTIVE ATTACHMENT CLIP

(76) Inventor: Mark Craighead, Republic, MO (US)

( * ) Notice: Subject to any disclaimer, the term of this patent is extended or adjusted under 35 U.S.C. 154(b) by 188 days.

(21) Appl. No.: 12/430,074

(22) Filed: Apr. 25, 2009

(65) Prior Publication Data

US 2010/0270349 A1 Oct. 28, 2010

(51) Int. Cl.
*F41C 33/02* (2006.01)
*F41C 33/04* (2006.01)

(52) U.S. Cl.
USPC ..... 224/587; 224/666

(58) Field of Classification Search
USPC ..... 224/193, 269, 578, 666, 678, 230, 911, 224/912
See application file for complete search history.

(56) References Cited

U.S. PATENT DOCUMENTS 1,887,780 A * 11/1932 Noel ..... 224/230
3,942,692 A * 3/1976 Chica ..... 224/243
3,982,675 A * 9/1976 Claypool ..... 224/666
4,667,374 A * 5/1987 Bianchi ..... 24/3.9
4,718,585 A * 1/1988 Atkins, Sr. ..... 224/238
4,953,770 A * 9/1990 Bond, Sr. ..... 224/250
4,986,459 A * 1/1991 Yarbrough, Jr. ..... 224/661
5,103,884 A * 4/1992 Roman ..... 150/134
5,582,338 A * 12/1996 Tamura ..... 224/678
6,092,703 A * 7/2000 Johnson ..... 224/198
6,641,009 B2 * 11/2003 French et al. ..... 224/244
6,988,296 B1 * 1/2006 McGarity et al. ..... 24/67.3
2007/0140924 A1 * 6/2007 Hill ..... 422/124

* cited by examiner

*Primary Examiner* — Adam Waggenspack
(74) *Attorney, Agent, or Firm* — Lathrop & Gage LLP

(57) ABSTRACT

A concealable handgun holster is disclosed with a handgun encasement supported within clothing of a wearer by one or more attachment clips, the attachment clips being hidden "in plain sight" by decorative features that deceive an observer into thinking the clips are decorations rather than part of a holster. In preferred embodiments, the holster is a hybrid holster with a handgun encasement formed by a leather sheet attached to a rigid plastic cover, preferably made of Kydex®. The clips can be plastic or metal, preferably steel, and can be attached to the encasement by rivets, screws, or any other suitable fastening means known in the art. Decoration of the attachment clips can be by shaping of the clips, perforation of the clips with decorative shapes, engraving on the clips, printing on the clips, and/or attachment of decorative items to the clips.

14 Claims, 5 Drawing Sheets

CONCEALABLE HANDGUN HOLSTER WITH DECEPTIVE ATTACHMENT CLIP

FIELD OF THE INVENTION

The invention generally relates to holsters for handguns, and more specifically to concealable holsters for handguns.

BACKGROUND OF THE INVENTION

Handguns represent a popular class of weapon, since they are highly portable, and can be used for both sport and for personal protection. The portability and convenience of a handgun can be enhanced through use of a holster, typically fastened to the waste of the user, so as to provide for convenient and secure carrying of the handgun while leaving the hands and body free of encumbrances.

When personal protection is the primary goal, it is often desirable to carry a handgun in a concealable manner, so as to provide for desired accessibility and protection without alarming nearby individuals who may be intimidated by the sight of a handgun, or may have other strong feelings regarding the carrying of weapons. In these situations, it is common to use a concealable holster for carrying the handgun. Such concealable holsters are typically worn inside of the pants and shirt of the user, and are attached to the user's waistband by one or more clips that extend over the top rim of the waistband and attach thereto.

So as to make a concealable holster more difficult to detect, it is desirable for the holster to have as small a profile as possible. For this reason, a popular design for concealable holsters is to attach a rigid gun encasement to a sheet of leather so as to form a compartment between the encasement and the leather that is suitable for carrying a handgun. Such holsters are referred to herein as "concealable hybrid" holsters. The sheet of leather provides a flexible and comfortable barrier that can rest against the body of the user, while the rigid encasement prevents the user's clothing from applying pressure to the handgun in the holster, thereby allowing the handgun to be quickly retrieved without rubbing against, or otherwise catching on the user's clothing.

While a concealable handgun holster is mainly hidden by the clothing of a user, the attachment clips are generally visible, since they must extend over the waistband of the user and downward for a short distance on the outward facing side of the waistband. If a belt is worn by the user, the belt can be made to pass over the attachment clips so as to partially hide them. Also, the attachment clips are typically made as small and thin as possible. However, the clips must be sufficiently large and thick to provide durable and secure support of the holster and handgun. Thus, it is impossible to fully conceal portions of the attachment clips from the view of bystanders. This can cause the clips to draw attention to the otherwise concealed handgun and holster, and compromise the desired concealment.

SUMMARY OF THE INVENTION

A concealable handgun holster is claimed that includes one or more attachment clips that are decorative in appearance, thereby "hiding" the attachment clips in plain sight, in that they are configured so as to be clearly visible when worn, but are designed to deceive an observer into thinking that they are simple adornments, and therefore do not tend to alert the observer to the presence of the concealed holster attached by the clips. The clips are preferably made of steel, and can be attached to the handgun holster by rivets, screws, or any other convenient fastening means known in the art. Attachment clip decorations on the visible portion of the clip can include decorative shaping of the clip itself, decorative openings cut into the clip that allow the user's waistband and/or belt to show through, decorative engravings applied to the clip, and decorative markings and images applied to the clip.

One general aspect of the present invention is a concealable handgun holster that includes an encasement suitable for carrying a handgun at least partially concealed within a waistband of a user and at least one attachment clip fastened to the encasement. The attachment clip is decorative in appearance, and able to support the encasement within the waistband, while appearing to be only an adornment of a belt worn about the waistband.

In some preferred embodiments, the attachment clip is made of plastic. In other preferred embodiments, the attachment clip is made of metal, and in some of these embodiments the attachment clip is made of steel. In other preferred embodiments, the encasement is at least partly made of an acrylic-PVC hybrid plastic. And in some of these embodiments the acrylic-PVC hybrid plastic is Kydex®.

In some preferred embodiments, the holster includes only one attachment clip. In other preferred embodiments, the holster includes a total of two attachment clips.

In preferred embodiments the attachment clip includes decorative shaping. In other preferred embodiments the attachment clip includes decorative perforations. In yet other preferred embodiments the attachment clip includes decorative engraving. In still other preferred embodiments the attachment clip includes decorative printing. And in still further preferred embodiments the attachment clip includes decorative items attached thereto.

In preferred embodiments, the holster is a hybrid holster, the encasement being formed by a leather sheet and a rigid plastic cover attached to the leather sheet and forming therewith a compartment suitable for securing a handgun. Another general aspect of the present invention is a concealable holster that includes an encasement suitable for carrying a handgun and at least one attachment clip fastened to the encasement. The at least one attachment clip is extendable over the waistband of a user so as to support the encasement in substantial concealment beneath clothing of the user while only an exposed portion of the at least one attachment clip remains visible, and the exposed portion of the at least one attachment clip is decorative in appearance, so as to enhance the concealment of the holster by appearing to be only a decoration attached to the waistband.

In some preferred embodiments the decorative portion of the attachment clip includes decorative shaping. In other preferred embodiments the decorative portion of the attachment clip includes decorative perforations. In still other preferred embodiments the decorative portion of the attachment clip includes decorative engraving. In yet other preferred embodiments the decorative portion of the attachment clip includes decorative printing. And in still further preferred embodiments the decorative portion of the attachment clip includes decorative items attached thereto.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1A:
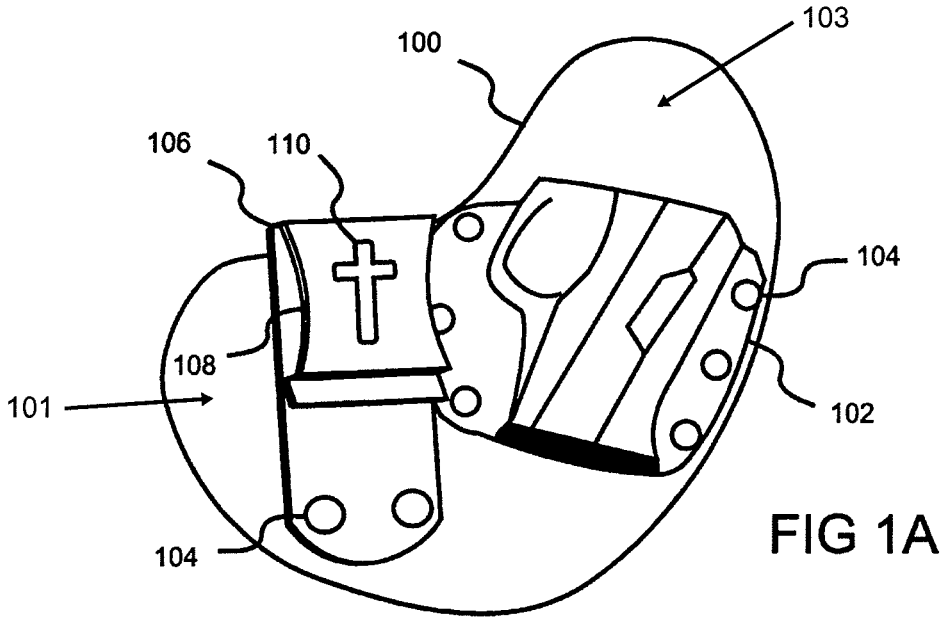
FIG. 1A is a front illustration of a concealable hybrid holster of the present invention in an embodiment with only one plastic attachment clip that includes a decoratively curved sides and a decorative hole cut in the shape of a crucifix.
Figure 1B:
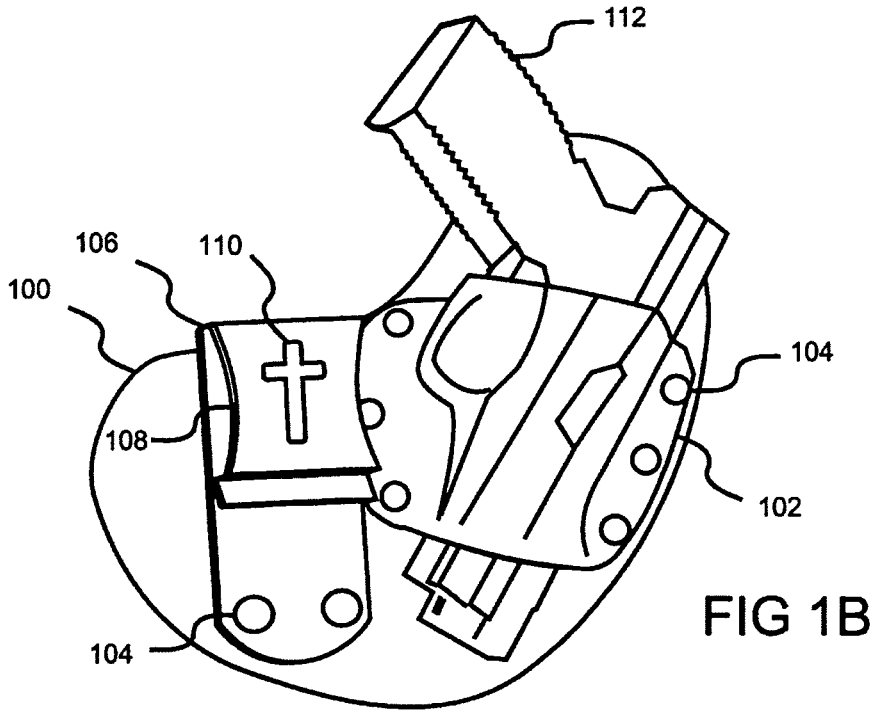
FIG. 1B is a front illustration of the concealed hybrid holster of FIG. 1A with a handgun inserted into the holster.

FIG. 1A is an illustration of a concealable holster of the present invention in an embodiment wherein the concealable holster is a concealable hybrid holster. In other embodiments, the holster is made of any concealable holster material and configuration known in the art. The concealable hybrid holster includes a leather sheet 100 to which a rigid plastic cover 102 is attached, so as to form a compartment suitable for carrying a handgun. In the embodiment of FIG. 1A, the rigid plastic cover 102 is attached to the leather sheet 100 by rivets. At least one attachment clip 106 is also attached to the leather sheet 100, and is used to attach the holster to the waistband of pants worn by the user. The embodiment of FIG. 1A is intended for use with small handguns, and requires only one plastic attachment clip 106. Typically, the rigid plastic cover 102 and attachment clip 106 are made from a strong and highly rigid plastic, typically an acrylic-PVC alloy such as Kydex® (Kydex is a registered trademark of Kleerdex Company). In the embodiment of FIG. 1A, the plastic attachment clip 106 includes decoratively curved sides 108 and a decorative hole 110 in the shape of a crucifix. In similar embodiments, the attachment clip 106 includes decorative features such a decorative engraving, decorative printing, and attachment of decorative items such as gems, rhinestones, pearls, and other decorative objects. These decorative features serve to hide the clip "in plain sight" by deceiving an observer into thinking that the clip 106 is nothing more than an adornment worn over the belt of a user. Thus, an essential utility of these decorative features is that they enhance the concealment of the clip, and consequently the concealment of the entire holster. FIG. 1B illustrates placement of a handgun 112 in the holster of FIG. 1A.

The sheet 100 depicted in FIG. 1A comprises a waistband portion 101 and a guard portion 103 extending upwardly from waistband portion 101.

Figure 2B:
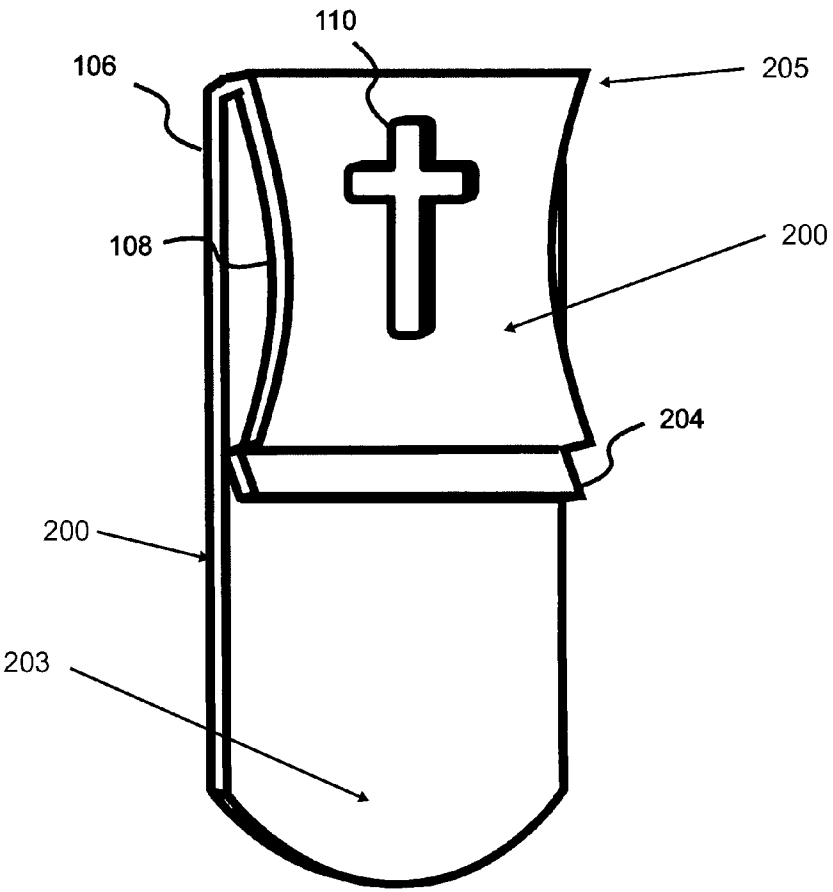
FIG. 2B is a close-up front view of the attachment clip of FIG. 1A.
Figure 2A:
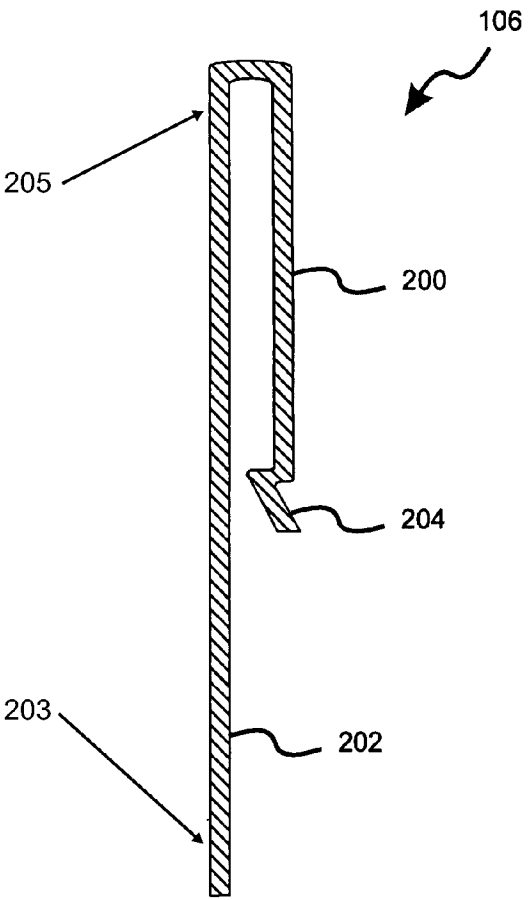
FIG. 2A is a side view of the attachment clip of FIG. 1A.

FIG. 2A is a side view of the attachment clip 106 of FIG. 1A. The attachment clip 106 includes an upper portion 200 that is able to extend over the waistband of a user and attach to the user's waistband and/or belt, and a lower portion 202 that is attachable to the leather sheet 100 of the holster. The embodiment of FIG. 2A also includes a flange 204 that facilitates attachment of the clip to a waistband and/or belt by helping to momentarily open the clip as it is pressed against the waistband and/or belt. FIG. 2B is a front view of the attachment clip 106 of FIG. 2A, showing the decoratively curved sides 108 of the attachment clip 106 and the decorative hole 110 formed in the shape of a crucifix.

The lower portion 202 of the clip has a lower end 203 and an upper end 205. The upper portion 200 of the clip extends downwardly from the upper end 205 of lower portion 202. A first retention area 207 is formed between the lower portion 202 and upper portion 200. A second retention area is formed between the upper end 205 of the lower portion 202 of the clip and the first side of the sheet 100.

Figure 2D:
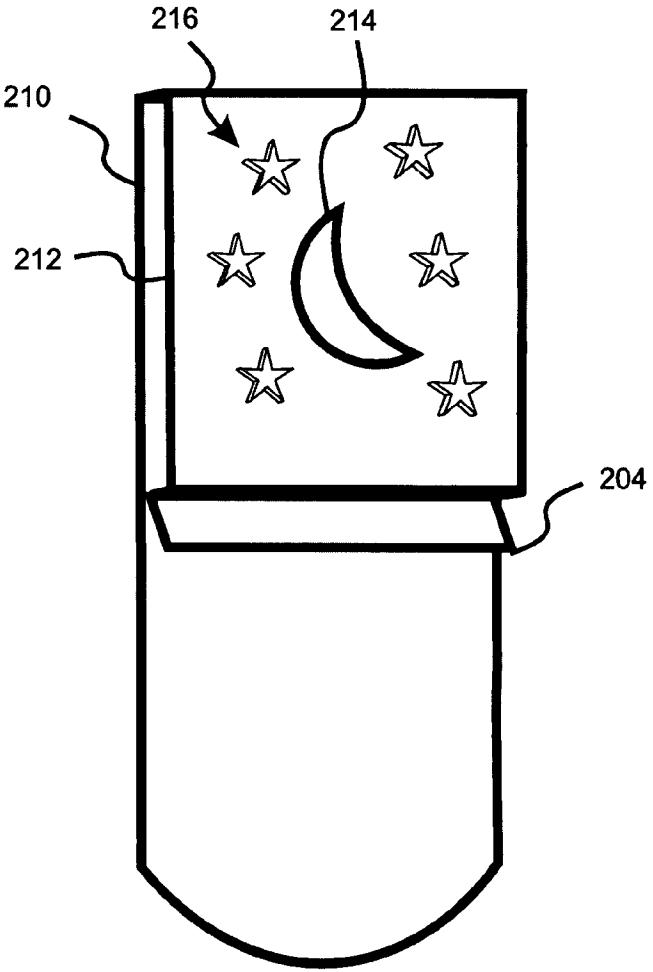
FIG. 2D is a front view of a decorative attachment clip of the present invention, including straight sides and an engraved decorative moon and stars pattern.
Figure 2C:
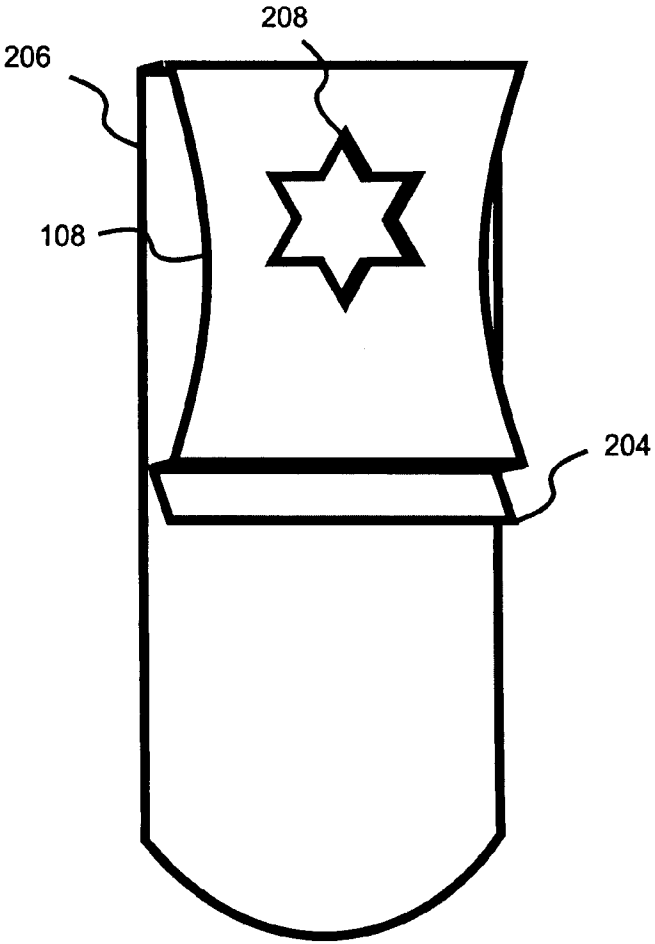
FIG. 2C is a front view of a decorative attachment clip of the present invention, including curved sides and a decorative hole in the shape of a Star of David.

FIG. 2C is a front view of an attachment clip 206 similar to the attachment clip 106 of FIG. 2B, but made of metal and including a decorative hole 208 in the shape of a star of David. FIG. 2D is a front view of an attachment clip 210 similar to the attachment clip 208 of FIG. 2C, but having straight sides 212 and including a decorative engraving of a moon 214 and rhinestone stars 216 glued thereto.

Figure 3A:
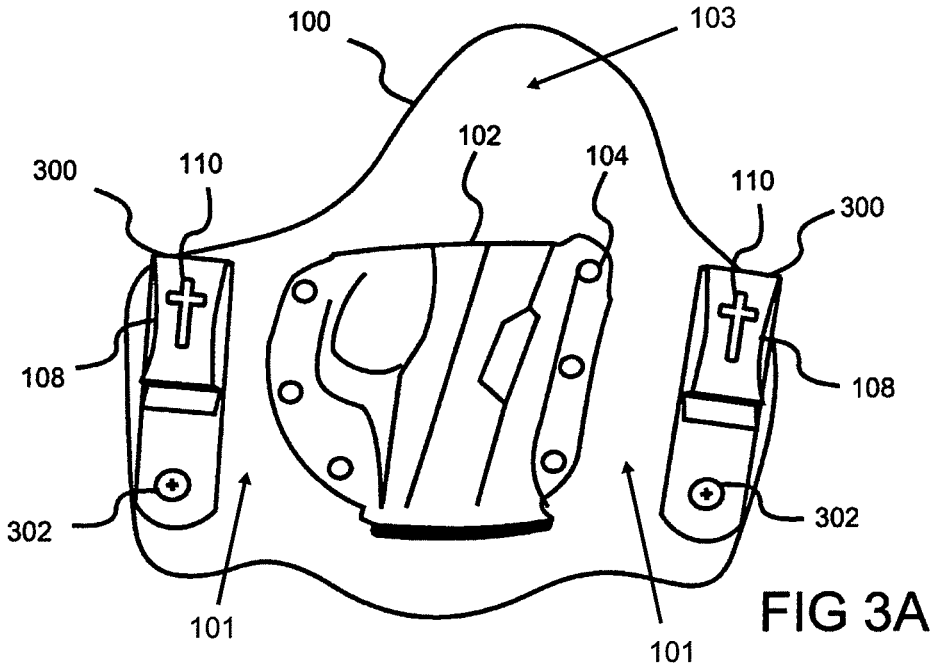
FIG. 3A is a front illustration of a concealable hybrid holster of the present invention in an embodiment with two metal attachment clips with curved sides and decorative holes in the shape of crucifixes.
Figure 3B:
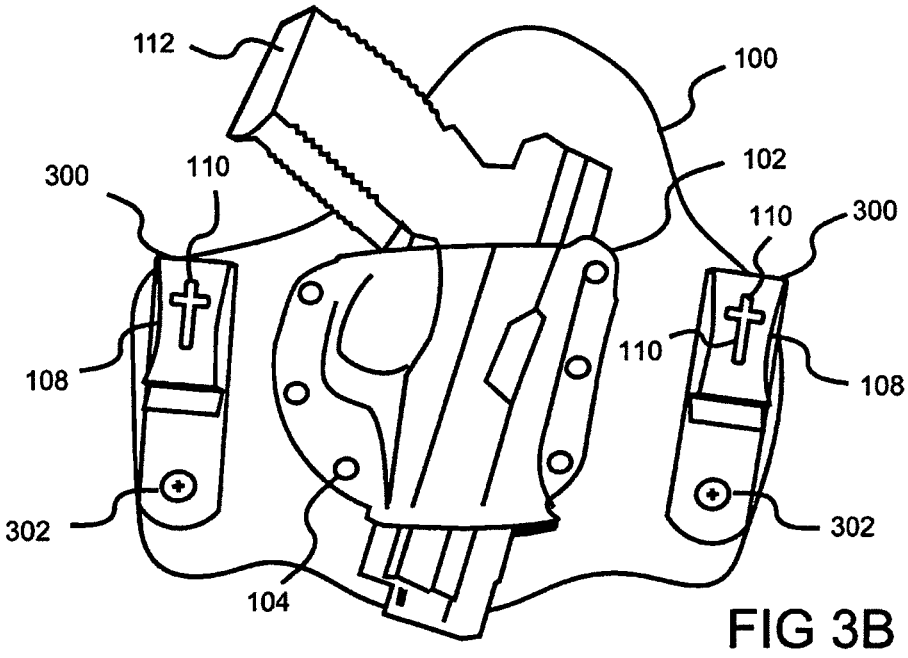
FIG. 3B is a front illustration of the concealed hybrid holster of FIG. 3A with a handgun inserted into the holster.

FIG. 3A is an illustration of a concealable hybrid holster similar to the holster of FIG. 1A, but intended for use with larger and heavier handguns. In this embodiment the shape and size of the leather sheet 100 are sufficient to allow a metal clip 300 to be attached on each side of the rigid plastic cover 102. In this embodiment, the metal clips 300 include decoratively curved sides 108 and decorative holes 110 in the shape of crucifixes, and are attached to the leather sheet 100 by screws 302. FIG. 3B illustrates placement of a handgun 112 in the holster of FIG. 3A.

Figure 4A:
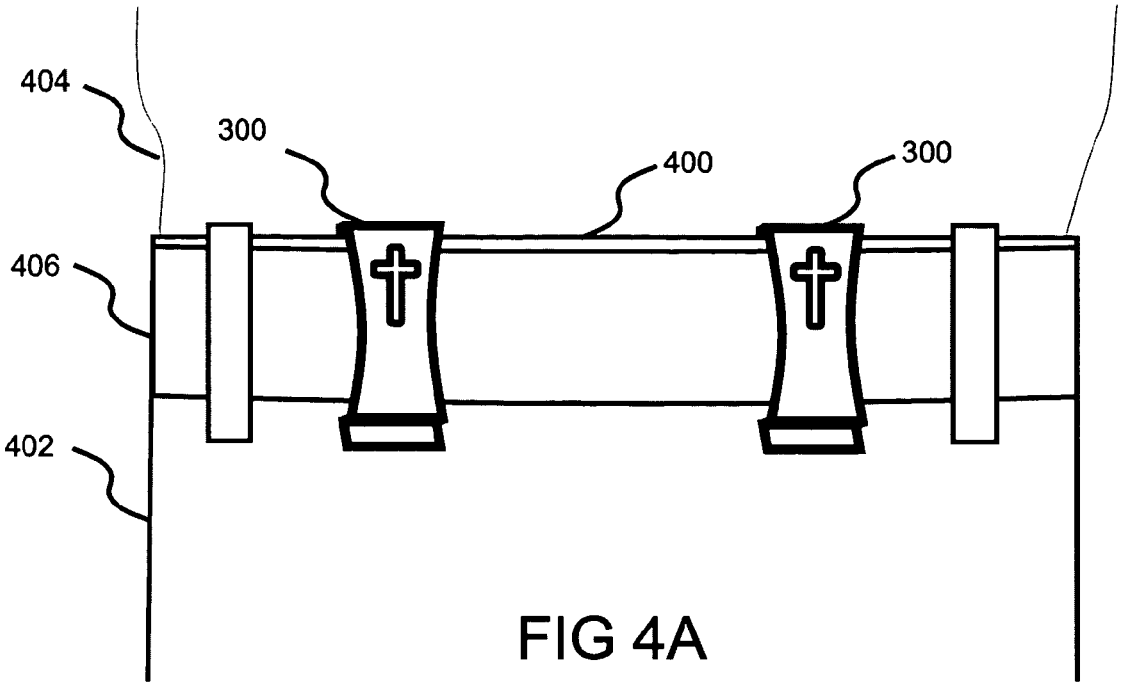
FIG. 4A is a perspective view from the side of a user wearing the holster of FIG. 3A with the user's shirt pulled down over the upper portion of the holster.
Figure 4B:
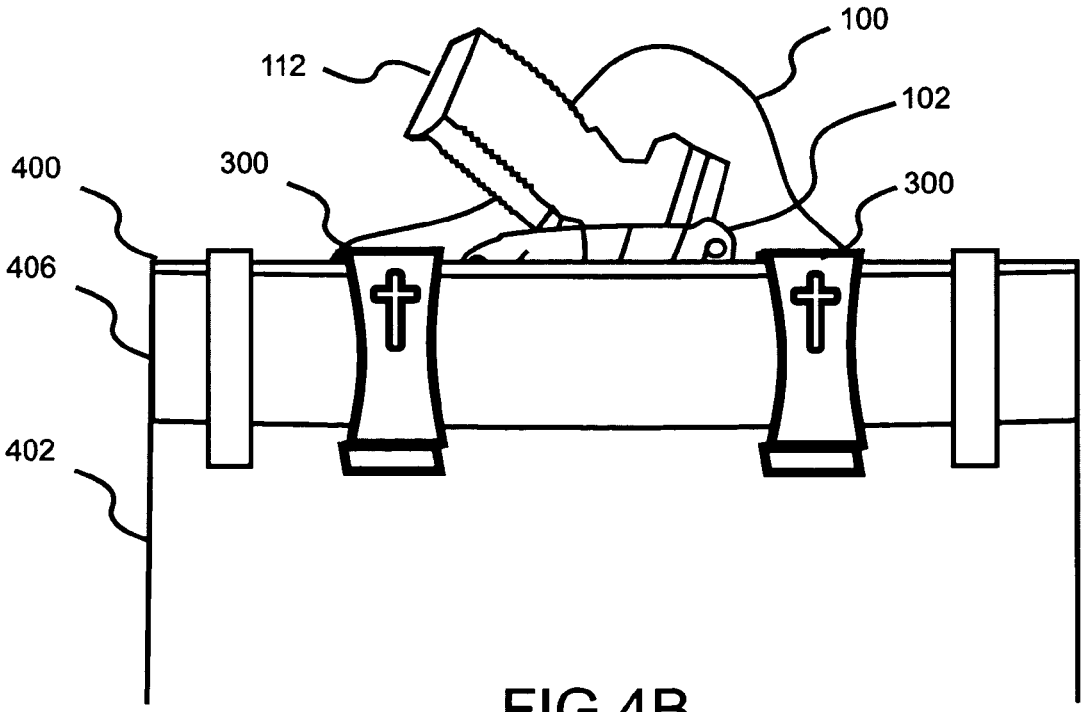
FIG. 4B is a perspective view from the side of a user wearing the holster of FIG. 4A with the user's shirt pulled up so as to reveal the upper portion of the holster and a handgun contained therein.

FIG. 4A is an illustration showing the holster of FIG. 3B being worn by a user. The lower half of the holster is tucked behind the waistband 400 of pants 402 worn by the user, while the upper half of the holster is hidden behind a shirt 404 worn by the user. Portions of the decorative attachment clips 300 are visible extending over the waistband 400 and belt 406 of the user, but appear to be simply decorations worn over the belt 406. In FIG. 4B, the shirt 404 has been pulled away from the holster to reveal the upper portion of the holster.

Other modifications and implementations will occur to those skilled in the art without departing from the spirit and the scope of the invention as claimed. Accordingly, the above description is not intended to limit the invention except as indicated in the following claims.

What is claimed is:

1. A holster for a handgun capable of concealment within a waistband of a lower garment of a user and underneath the upper garment of a user, the holster comprising:

a sheet having a first and a second side, the sheet having a waistband portion and a guard portion extending upwardly from the waistband portion;

a rigid member attached to the first side of the waistband portion of the sheet, and forming with the first side of the sheet, an encasement for a handgun;

at least one attachment clip attached to the first side of the waistband portion of the sheet and horizontally disposed relative to the rigid member, the at least one attachment clip comprising a lower portion attached to the sheet, an upper portion extending upwardly from the lower portion, said upper portion not attached to the sheet, and a retention portion extending downwardly from an upper end of the upper portion;

wherein the upper portion and the retention portion of the at least one attachment clip define a first retention area for retaining a lower garment of a user over the waistband portion and over the rigid member for concealing a handgun disposed in the holster; and wherein the first side of the sheet and the upper portion of the at least one attachment clip define a second retention area for retaining an upper garment of a user over the guard portion and rigid member for concealing a handgun disposed in the holster.

2. The holster of claim 1 wherein only the upper portion of the at least one attachment clip is not concealed by an upper and a lower garment of a user when a lower garment is disposed in the first retention area and an upper garment is disposed in the second retention area.

3. A holster for a handgun capable of concealment with a waistband of a lower garment and an upper garment of a user comprising:

an encasement formed from a sheet having a first and second side, and a rigid member attached to the first side of the sheet; and at least one attachment clip fastened to the first side of the sheet for attaching the holster to a waistband, the at least one attachment clip being decorative in appearance, and able to support the encasement within a waistband of a lower garment, while appearing to be only an adornment of a belt worn about a waistband;

wherein the sheet comprises a waistband portion and a guard portion extending upwardly from the waistband portion;

wherein the rigid member is disposed on the waistband portion of the sheet and the waistband portion of the sheet extends horizontally to one or both sides of the rigid member;

wherein the at least one attachment clip is fastened to the waistband portion of the sheet and horizontally disposed relative to the rigid member when a waistband of a lower garment is disposed through the at least one attachment clip and over the rigid member;

wherein the holster may be disposed between a user and a waistband of a lower garment with the second side of the sheet disposed toward the a user and the rigid member disposed toward the inside of a waistband of a lower garment; and wherein the at least one attachment clip further comprises a lower portion attached at a lower end thereof to the waistband portion, an upper end of the lower portion extending upwardly from the lower end, said upper end not attached to the sheet, and an upper portion extending downwardly from the upper end of the lower portion on the side of the lower portion disposed away from the first side of the sheet;

wherein the upper portion and the upper end of the lower portion define a first retention area for retaining a waistband of a lower garment;

wherein the rigid member and the waistband portion of the sheet are substantially concealed when a waistband of a lower garment is disposed through the at least one attachment clip and over the rigid member.

4. The holster of claim 3 wherein the upper portion of the at least one attachment clip further comprises at least one decorative element selected from the group consisting of decorative shaping, decorative perforation, decorative engraving, and decorative printing.

5. The holster of claim 4 wherein the first side of the sheet and the upper end of the lower portion of the at least one attachment clip define a second retention area for retaining the upper garment; wherein the guard portion is substantially concealed when an upper garment is disposed in the second retention area.

6. The holster for a handgun of claim 5, wherein the holster is a hybrid holster formed from a sheet made of leather and a rigid member made of plastic.

7. The holster of claim 6 wherein the top of the encasement is disposed substantially at the top of a waistband of a lower garment when a waistband of a lower garment is disposed in the first retention area of the at least one attachment clip.

8. A holster for concealing a handgun in the upper garment and a waistband of a lower garment of a user comprising:

an encasement for carrying a handgun comprising a sheet having a first side and a second side and a rigid member attached to the first side of the sheet forming a compartment for receiving the handgun; and at least one attachment clip having a lower portion fastened to the first side of the sheet at a lower end thereof and an upper end extend upwardly from the lower end, said upper end not attached to the sheet, and an upper portion extending downwardly from the upper end of the lower portion and defining a first retention area therebetween, the upper portion being extendable over the waistband of a user's clothing so as to support the encasement in substantial concealment beneath a lower garment of a user while only the upper portion of the at least one attachment clip remains visible;

wherein the sheet comprises a waistband portion and a guard portion extending upwardly therefrom;

wherein the waistband portion extends horizontally to one or both sides of the rigid member;

wherein the at least one attachment clip is fastened to the waistband portion of the sheet and horizontally disposed relative to the rigid member; and wherein the holster may be disposed between a user and a waistband of a lower garment with the second side of the sheet disposed toward a user and the rigid member disposed toward the inside of a waistband of a lower garment;

wherein the rigid member and the waistband portion of the sheet are substantially concealed when a waistband of a lower garment is disposed through the first retention area of the at least one attachment clip and over the rigid member.

9. The holster of claim 8 wherein the holster and a handgun disposed therein are concealed except for the upper portion of the at least one attachment clip when a waistband of a lower garment is disposed in the first retention area and over the rigid member, and an upper garment is disposed in a second retention area defined by the first side of the sheet and the upper end of the lower portion of the at least one attachment clip.

10. The holster for a handgun of claim 9, wherein the attachment clip includes decorative shaping.

11. The holster for a handgun of claim 9, wherein the attachment clip includes at least one decorative perforation.

12. The holster for a handgun of claim 9, wherein the attachment clip includes decorative engraving.

13. The holster for a handgun of claim 9, wherein the attachment clip includes decorative printing.

14. The holster for a handgun of claim 9, wherein the attachment clip includes decorative items attached thereto.

* * * * *